US009308746B2

(12) United States Patent
VanDemark et al.

(10) Patent No.: US 9,308,746 B2
(45) Date of Patent: Apr. 12, 2016

(54) MULTIPURPOSE PRINTER

(71) Applicant: NCR Corporation, Duluth, GA (US)

(72) Inventors: Michael J. VanDemark, Springboro, GA (US); Mark E. Keeton, Kettering, OH (US); Timothy W. Rawlings, Waynesville, OH (US)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 14/507,052

(22) Filed: Oct. 6, 2014

(65) Prior Publication Data

US 2015/0022581 A1 Jan. 22, 2015

Related U.S. Application Data

(62) Division of application No. 12/589,978, filed on Oct. 30, 2009, now Pat. No. 8,985,738.

(51) Int. Cl.

| | |
|---|---|
| ***B41J 2/015*** | (2006.01) |
| ***B41J 25/308*** | (2006.01) |
| ***B41J 3/60*** | (2006.01) |
| ***B41J 3/407*** | (2006.01) |
| ***G03G 15/23*** | (2006.01) |
| ***G03G 15/00*** | (2006.01) |
| ***B41J 2/01*** | (2006.01) |
| ***B41J 2/32*** | (2006.01) |
| ***B41J 3/42*** | (2006.01) |

(52) U.S. Cl.
CPC .... *B41J 3/60* (2013.01); *B41J 2/01* (2013.01); *B41J 2/32* (2013.01); *B41J 3/4075* (2013.01); *B41J 3/42* (2013.01); *G03G 15/238* (2013.01); *G03G 15/50* (2013.01); *G03G 2215/00021* (2013.01)

(58) Field of Classification Search
CPC ..... B41J 3/60; B41J 3/42
USPC ..... 347/8, 20
See application file for complete search history.

(56) References Cited

U.S. PATENT DOCUMENTS

| | | | | |
|---|---|---|---|---|
| 2006/0210342 | A1* | 9/2006 | Fujikawa et al. | 400/586 |
| 2008/0094461 | A1* | 4/2008 | Terada et al. | 347/104 |
| 2008/0180505 | A1* | 7/2008 | Yoda | 347/104 |
| 2008/0297583 | A1* | 12/2008 | Lyons et al. | 347/211 |

* cited by examiner

*Primary Examiner* — Jason Uhlenhake
(74) *Attorney, Agent, or Firm* — Michael Chan; Schwegman, Lundberg & Woessner

(57) ABSTRACT

A multipurpose printer and techniques for operating the printer are presented. A printer includes first and second print elements. During a first mode of operation for the printer, both the first and second print elements are configured to image both first and second sides of print media passing through the printer. During a second mode of operation, the first print element is prevented from interfacing with at least portions of the first side of the media that include adhesive materials affixed thereto.

7 Claims, 3 Drawing Sheets

MULTIPURPOSE PRINTER

CROSS-REFERENCE TO RELATED APPLICATION

The present application is a divisional application and claims the benefit of the filing date of application Ser. No. 12/589,978, filed Oct. 30, 2009, entitled, "A Multipurpose Printer".

BACKGROUND

Enterprises and individuals are increasingly demanding more complex printing solutions. That is, printing features that use to require a separate professional service are now being demanded by consumers.

In large part, the print industry's responses to these demands have been to provide print media having multiple characteristics. For instance, varied dimensions of media and various types of adhesive materials affixed to the media have been provided. Additionally, the media can be thermally coated to permit thermal imaging on one or both sides of thereof. So, the media types can include their own individual characteristics and features.

Media that includes adhesive materials typically has to be processed by a special type of adhesively-sensitive printer, whereas media requiring dual-sided imaging requires another special type of printer. As a result, enterprises carry multiple types of printers, each printer type for a specific printing need of the enterprises.

This situation is costly for an enterprise and causes support issues because when one type of printer breaks down or fails, the failed printer cannot be swapped out with another type of printer that remains operational.

In addition, some types of printers are rarely if ever used within an enterprise; so, there are operational inefficiencies within the enterprise. Furthermore, there is additional environmental waste by carrying multiple types of printers because each printer type requires its own independent electrical power source, each individual printer has its own byproducts, and each individual printer has to be disposed of when its useful life comes to an end.

Thus, it can be seen that improved printers that can image multiple types of media are desirable.

SUMMARY

In various embodiments, a multipurpose printer is presented. According to an embodiment, the printer includes a first print head configured to interface with a first side of media and to image the first side of the media during a first mode of operation for the printer. The printer further includes a second print head configured to interface with a second side of the media and to image the second side of the media during the first mode for operation of the printer. The printer also including a disengagement mechanism configured to protect the first print head from interfacing with the first side of the media during a second mode of operation for the printer. The second mode of operation including operation with an adhesive material affixed to the first side of the media.

DETAILED DESCRIPTION

Figure 1A:
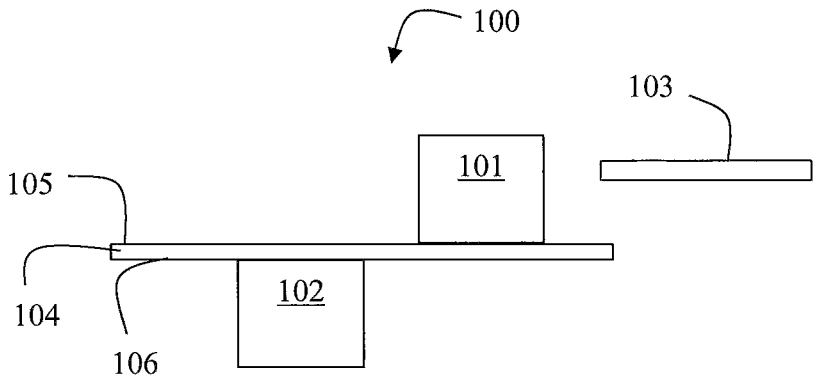
FIGS. 1A and 1B are diagrams of a multipurpose printer configured for a first mode of operation (FIG. 1A) and a second mode of operation (FIG. 1B), according to an example embodiment.
Figure 1B:
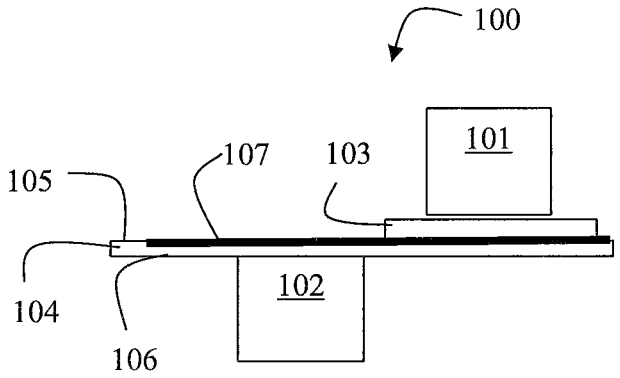

FIGS. 1A and 1B are diagrams of a multipurpose printer 100 configured for a first mode of operation (FIG. 1A) and a second mode of operation (FIG. 1B), according to an example embodiment. The multipurpose printer 100 (hereinafter "printer") can be a dual-sided thermal printer 100, a dual-sided ink jet printer 100, or a dual-sided thermal and inkjet printer 100 (e.g., one-sided thermal and one-sided inkjet). Variations are possible (e.g., dual-sided thermal and one-sided inkjet, or one-sided thermal and dual-sided inkjet).

Moreover, the printer 100 can include one or more processors configured to execute a variety of software instructions that reside in computer-readable storage media within the printer 100. Additionally, the printer 100 can be interfaced to a network and accessible over the network. The network can be a wide-area network (WAN), such as the Internet, or a local-area network (LAN) located, for example, within a firewall of an enterprise.

The printer 100 includes, inter alia, a first print head 101, a second print head 102, and a disengagement mechanism or device 103. Each of these and their interactions with one another and the printer 100 is now discussed with reference to the FIG. 1A and FIG. 1B.

The printer 100 has at least two modes of operation. The first mode depicted in FIG. 1A and the second mode of operation depicted in FIG. 1B. Each mode of operation results in imaging or printing on a print media 104. The print media 104 includes a first side 105 and a second side 106. During a first mode of operation, the printer 100 images or prints on both sides 105 and 106 of the print media 104. During a second mode of operation, the printer 100 images or prints on just one side 106 of the print media 104.

The first print head 101 is configured and situated within the printer 100 such that it interfaces or comes into contact with the first side 105 of the print media 104. This configuration permits the first print head 101 to image or print onto the first side 105 of the print media 104 during the first mode of operation (FIG. 1A) for the printer 100.

The second print head 102 is also configured and situated within the printer 100 such that it interfaces or comes into contact with the second side 106 of the print media 104. Again, this configuration permits the second print head 102 to image or print onto the second side 106 of the print media 104 during the first mode of operation for the printer 100.

However, unlike the first print head 101, the second print head 102 is also configured to image or print onto the second side 106 of the print media 104 during the second mode of operation (FIG. 1B) for the printer 100.

According to an embodiment, the first 101 and second 102 print heads are thermal print heads. In another embodiment, the first 101 and the second 102 print heads are inkjet print heads. In yet another embodiment, the first print head 101 is a thermal print head and the second print head 102 is an inkjet print head. Likewise, in a further embodiment, the first print head 101 is an inkjet print head and the second print head 102 is a thermal print head.

The disengagement mechanism 103 is configured to protect the first print head 101 from interfacing or coming into contact with the first side 105 of the print media 104 during the second mode of operation for the printer 100.

It is noted that in one embodiment the second mode of operation includes a print media 104 that has an adhesive material 107 affixed to or applied to the first side 105 of the print media 104. The adhesive material 107 can cover all of the first side 105 or just selective locations of the first side 105.

Conventionally, passing print media 104 coated with adhesive material 107 through a conventional printer without protecting the print head that comes into contact with that print media 104 would cause the conventional printer to malfunction and/or cause the components of the conventional printer to require maintenance to clean the adhesive material 107 off of those components.

Such is not the case with multipurpose printer 100 because of the novel aspects of the disengagement mechanism 103.

Again, during the second mode of operation where the print media 104 includes the adhesive material 107 on the first side 105 of the print media 104, the second print head 102 continues to fully function and image or print the second side 105 of the print media 104.

According to an embodiment, the disengagement mechanism 103 is a low-friction and/or adhesion resistant (e.g., low-stick and/or non-stick) cover or plate that shields the first print head 101 from the first side 105 of the print media 104 during the second mode of operation for the printer 100. The adhesion resistant materials that coat the cover or plate can include such things as silicone, polytetrafluoroethylene (e.g., Teflon®), and the like.

In an embodiment, the disengagement mechanism 103, which may comprise an adhesion resistant cover, is automatically and dynamically activated by software that executes on one or more processors of the printer 100 when the second mode of operation is selected by and/or detected within the printer 100. The software includes instructions that reside in computer-readable storage media on the printer 100.

In another case, the disengagement mechanism 103, which may comprise an adhesion resistant cover, is manually activated via a switch, lever, and/or button associated with the printer 100.

In yet another situation, the disengagement mechanism 103 is activated by a software interface that executes on one or more processors of the printer 100. Again, the software interface may comprise instructions that reside on computer-readable storage media of the printer 100. Here, a user, via perhaps other software executing on other processors of a network, such as, for example, a terminal, kiosk or workstation associated and/or in communication with the printer 100, cause features of the software interface that executes on the processors of the printer 100 to activate the disengagement mechanism 103 indicating the second mode of operation for the printer 100 is active. It may also be the case that an automated service that executes on its own (independent of manual user action) via one or more processors of the network causes the features of the software interface to activate the disengagement mechanism 103. The automated service may be triggered by a configured event, such as a scheduled print job that occurs at a certain date and time, and the like.

In an embodiment, the disengagement mechanism 103 comprises software that executes on one or more processors of the printer 100 for, for example, controlling a location of the first print head 101. The software residing on computer-readable storage media of the printer 100. Here, the disengagement mechanism 103 may be configured to park or otherwise disengage the first print head 101 for purposes of preventing the first print head 101 from interfacing or coming into physical contact with the first side 105 of the print media 104 during the second mode of operation for the printer 100. Accordingly, the first print head 101 may include or be associated with a further mechanism for being parked or otherwise disengaged from the first side 105 of the print media 104.

In a similarly case as what was described with the latter embodiment, the disengagement mechanism 103 may be configured to reposition the first print head 101 to a physical location within the printer 100 that prevents the first print head 101 from interfacing or coming into physical contact within the first side 105 of the print media 104 during the second mode of operation for the printer 100.

It may also be the case that the printer 100 includes other physical components (e.g., platens, rollers, tensioners, cutters, and the like) situated on or in contact with the first side 105 of the print media 104 during the first mode of operation for the printer 100. In this situation, the disengagement mechanism 103 may be configured to shield, park, or otherwise disengage these other components of the printer 100 from coming into contact with the first side 105 of the print media 104 during the second mode of operation for the printer 100.

In some configurations, the disengagement mechanism 103 can selectively determine which of the two print heads 101 or 102 is going to come into contact with an adhesive material 107 positioned on one side (105 or 106) of the print media 100 and then selectively isolate and protect that particular print head 101 or 102. So, in this case, a user may have inserted the print media 104 incorrectly, such that the adhesive material 107 is to come into contact with the second print head 102 rather than the first print head 101. The disengagement mechanism 103 can detect such a situation and protect the second print head 102 during the second mode of operation (mode of imaging) in which the print media 104 includes at least one side (105 or 106) of the print media 100 having some adhesive material 107 thereon.

In an embodiment for the second mode of operation for the printer 100, the print media 104 may comprise a roll of media having an adhesive coating on one side thereof which media may be used for, for example, providing self-adhesive receipts (e.g., for providing a receipt on a label), as described in, for example. U.S. Pat. No. 7,588,811, and U.S. Patent Application Publication No. 2006/0134365, the entire contents of both of which are hereby incorporated by reference herein for all purposes. It is noted that the print media 104 can be any media 104, during the second mode of operation for the printer 100 that includes an adhesive material 107 on some or all of the first side 105 of the print media 104.

Figure 2A:
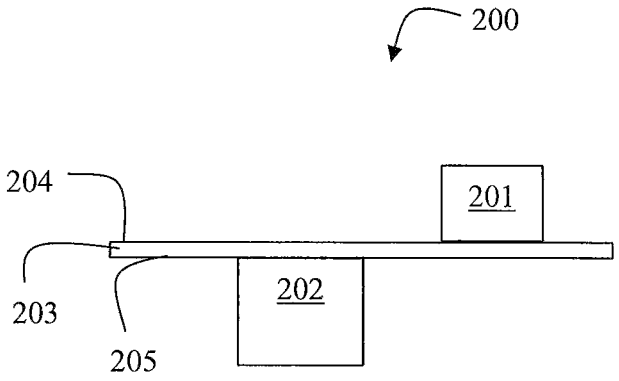
FIGS. 2A and 2B is a diagram of another multipurpose printer configured for a first mode of operation (FIG. 2A) and a second mode of operation (FIG. 2B), according to an example embodiment.
Figure 2B:
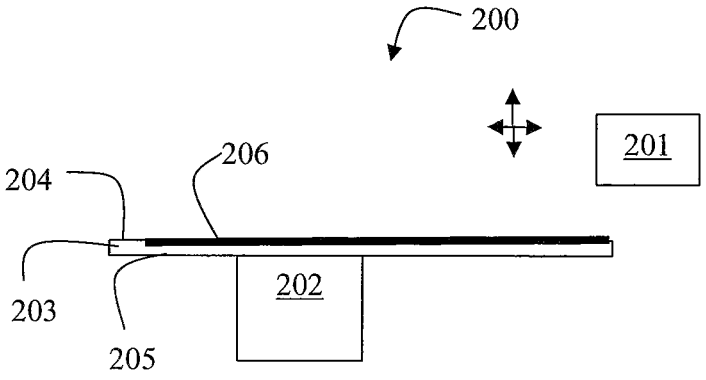

FIGS. 2A and 2B is a diagram of another multipurpose printer 200 configured for a first mode of operation (FIG. 2A) and a second mode of operation (FIG. 2B), according to an example embodiment. The multipurpose printer 200 (hereinafter "printer") can be a dual-sided thermal printer 200, a dual-sided ink jet printer 200, or a one-sided thermal and one-sided inkjet printer 200. Further variations are possible. Moreover, the printer 200 can include one or more processors configured to execute a variety of software instructions that reside in computer-readable storage media within the printer 200. Additionally, the printer 200 can be interfaced to a network and accessible over a network. The network can be a wide-area network (WAN), such as the Internet, or a local-area network (LAN) located, for example, within a firewall of an enterprise.

The printer 200 represents another and in some cases alternative configuration for the printer 100, presented above with respect to the discussion of the FIG. 1A and FIG. 1B.

The printer 200 includes, inter alia, a first print element 201 and a second print element 202. Each of these and their interactions with one another and the printer 200 is now discussed with reference to the FIG. 2A and FIG. 2B.

Again, it is noted that the printer 200 has at least two modes of operation (FIG. 2A representing the first mode and FIG. 2B representing the second mode). Each mode of operation results in imaging or printing on a print media 203. The print media 203 includes a first side 204 and a second side 205. During a first mode of operation, the printer 200 images or prints on both sides 204 and 205 of the print media 203. During a second mode of operation, the printer 200 images or prints on just one side 205 of the print media 203.

The first print element 201 is configured to image or print on the first side 204 of the print media 203 during the first mode of operation for the printer 200.

Similarly, the second print element 202 is configured to image or print on the second side 205 of the print media 203 during both the first and second modes of operations for the printer 200.

The first print element 201 is further configured to prevent or otherwise mitigate itself from interfacing or coming into contact with select portions of the first side 204 of the print media 203 during the second mode of operation for the printer 200. Such prevention or mitigation may be in response to, for example, select portions of the print media 203 on the first side 204 including adhesive material 206 affixed thereto or coated thereon.

According to an embodiment, the first 201 and the second 202 print elements are thermal print heads.

In an alternative embodiment, the first 201 and the second 202 print elements are inkjet print heads.

In a further embodiment, one of the first 201 and the second 202 print elements is a thermal print head, and the other of the first 201 and the second 202 print elements is an inkjet print head.

In a particular situation, the physical dimensions of the first print element 201 are narrower than the respective dimension associated with the print media 203 and/or second print element 202. The narrower physical dimensions of the first print element 201, relative to the media 203 and/or second print element 202, prevent the first print element 201 from contacting the select portions of the print media 203 such as portions having adhesive material 206 during the second mode of operation for the printer 200. In other words, the first print element 201 is manufactured such that it avoids contacting the select portions having the adhesive material 206 when the print media 203 passes through the printer 200 during the second mode of operation. For instance, the second print head 202 may have a dimension transverse to the direction of travel of the print media 203 (e.g., width-wise across a web of the media 203) of 3 inches whereas the first print head 201 may have a dimension transverse to the direction of travel of the print media 203 of 1 inch. Variations are possible.

According to an embodiment, the first print element 201 may be additionally or separately (e.g., where dimensioned like or separately from the second print element 202) configured to automatically relocate itself within the printer 200 to avoid interfacing or coming into contact with the first side 204 of the print media 203 during the second mode of operation for the printer 200. So, the first print element 201 may move itself up or to the side when the select portions having the adhesive material 206 pass through the printer 200 during the second mode of operation. As such, the first print element 201 can automatically park or disengage itself within the printer 200 during the second mode of operation. Such automatic parking or disengaging may occur in response to a configuration setting of the printer 200 which sets a mode of operation therefor, or dynamically in response to a variable measured during printer 200 operation such as, for example, detection of adhesive 206 on installed media 203, wherein the print head 201 may be parked or disengaged permanently (e.g., until otherwise overridden), or temporarily (e.g., until such detection ceases). In certain cases, the first print element 201 can additionally or alternatively be manually parked within the printer during the second mode of operation.

The directional arrows in FIG. 2B indicate that the first print element 201 can be moved in any direction (illustrated here as up-down and/or left-right, although variations are possible) during the second mode of operation to avoid contacting the adhesive material 206 of the first side 204 of the print media 203.

In another case, the printer 200 and/or first print element 201 may be configured to additionally or alternatively disable image capabilities associated with the first print element 201 during the second mode of operation for the printer 200. For example, while the first print element 201 may remain in contact or otherwise interfaced with the first side 204 of the media 203, print functionality (e.g., thermal heating) may be disabled to prevent or mitigate adhesion of adhesive 206 thereto.

It is noted, that configuration of the first print element 201 can occur via software instructions residing on the first print element 201 in computer-readable storage media and/or residing on computer-readable storage media of the printer 200. These instructions execute on one or more processors of the printer 200 and/or the first print element 201 and cause the first print element 201 to take evasive action to protect itself from the adhesive material 206 during the second mode of operation.

Figure 3:
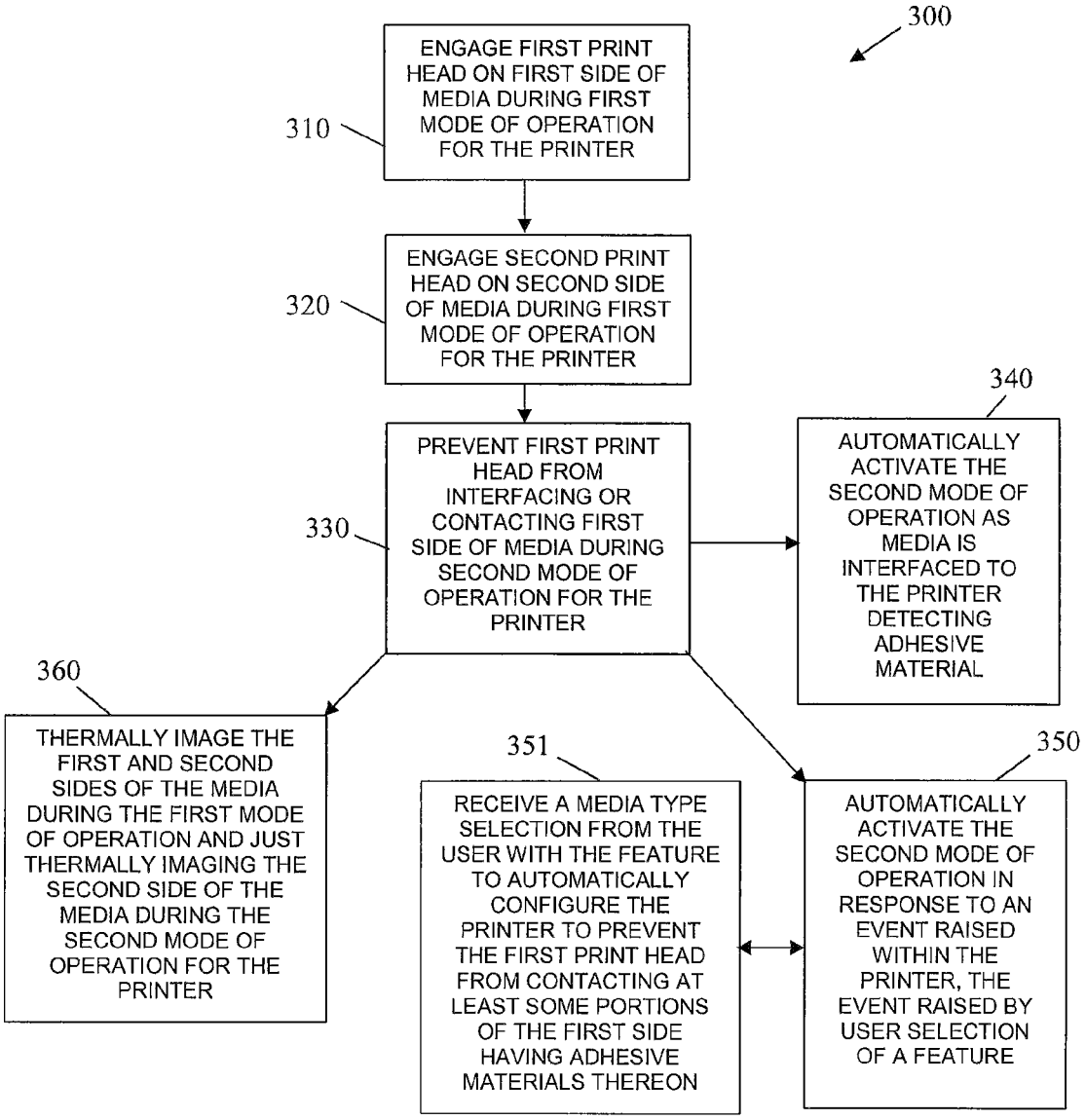
FIG. 3 is a diagram of a method for operating a multipurpose printer, according to an example embodiment.

FIG. 3 is a diagram of a method 300 for operating a multipurpose printer, according to an example embodiment. The method 300 (hereinafter "dual mode printing service") resides in a computer-readable storage medium and is executed on one or more processors of a printer, such as printers 100 and 200 of the FIGS. 1A and 1B, and 2A and 2B, respectively. The dual mode printing service may be accessible and operational over a network. The network may be wired, wireless, or a combination of wired and wireless. Moreover, the network may be a WAN and/or LAN.

The dual mode printing service represents processing that can occur on processors of the printers 100 and 200.

At 310, the dual mode printing service engages a first print head to image on a first side of a media during a first mode of operation for the printer.

At 320, the dual mode printing service engages a second print head to image on a second side of the media during the first mode of operation for the printer.

So, the printer is enabled during the first mode of operation to achieve dual-sided imaging. In an embodiment, the printer is a dual-sided thermal printer. In another case, the printer is a dual-sided inkjet printer. In a further embodiment, the printer is a one-sided thermal and one-sided inkjet printer.

At 330, the dual mode printing service prevents the first print head from interfacing or coming into contact with the first side of the media during a second mode of operation for the printer. The media has an adhesive material affixed or coated to at least some portions of the first side of the media during the second mode of operation for the printer.

In an embodiment, at 340, the dual mode printing service automatically and dynamically activates the second mode of operation within the printer as the media is interfaced to, or interfaces with, the printer by, for example, automatically detecting the adhesive material on the first side of the media.

Here, for example, when a user places the media into a recess or tray of the printer and the printer grabs the web or loads a first sheet of the media, sensors of the printer detect the adhesive material on the first side of the media and the dual mode printing service activates the second mode of operation causing the printer to configure itself in manners discussed above with respect to the printers 100 and 200 of the FIGS. 1A and 1B, and 2A and 2B, respectively.

Detection of adhesive may, for example, be visual/optical (e.g., reflectance, absorptance, refractive, and the like) or tactile/mechanical (e.g., tackiness, drag, thickness, web tension, and the like), and may be of, or resulting from interaction of, the adhesive itself, or associated indicia (e.g., a sense mark, bar code, numeric sequence, color bar, and the like) indicating presence (or absence) of adhesive. Further, detection of adhesive may also occur for preloaded media such that, for example, a second mode of operation may automatically and dynamically be enabled and executed as adhesive is detected during printer operation/as the media is fed through the printer. Irrespective, once enabled, printer operation may, then, proceed under the second mode of operation until overridden by, for example, external command (e.g., as a result of a signal received from an associated computer or terminal, or a manually enabled signal, switch or setting adjustment), or until adhesive is no longer sensed, at which point the printer may revert back to a first mode of operation. In one embodiment, a printer may automatically cycle between a first and a second mode of operation as media is fed through the printer and the presence or absence of adhesive is sensed. In another embodiment, once enabled, a printer may persist in a second mode of operation until the media is replaced (as indicated by, for example, a signal from a media-out sensor, a printer-open sensor signal, and the like), or overridden by a user and/or associated computer command.

In another situation, at 350, the dual mode printing service automatically and dynamically activates the second mode of operation in response to an event raised within the printer. The event in this situation is raised by a user selection of a feature, which indicates the first side of the media includes the adhesive material. Here, a user activates a button or switch on the printer to cause the raised event. Alternatively, software interfaces accessed by the user raise the event detected by the dual mode printing service.

Continuing with the embodiment of 350 and at 351, the dual mode printing service receives a media type selection from the user and in response thereto automatically and dynamically configures the printer to prevent the first print head from interfacing with those portions of the first side of the print media having the adhesive material. The media type selection provides physical dimensions and locations from the portions on the first side having the adhesive material. In other words, when a media type is selected, the dual mode printing service can lookup the physical dimensions associated with the selected media type and determine how and where the adhesive materials are located on the first side of the print media, and adjust a response accordingly such as, but not limited to, moving a first print element away from adhesive containing regions of the media while remaining in contact or otherwise interfaced with the media in non-adhesive containing regions for printing or imaging therein.

According to an embodiment, at 360, the dual mode printing service thermally images the first and second sides of the print media during the first mode of operation for the printer and thermally images just and only the second side of the print media, or the second side of the print media and select portions of the first side, during the second mode of operation for the printer.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A printer, comprising:

a first print element configured to image on a first side of media during a first mode of operation for the printer; and a second print element configured to image on a second side of the media during the first mode of operation for the printer;

the printer being configured to prevent the first print element from interfacing with select portions of the first side of the media during a second mode of operation for the printer, the select portions of the media having adhesive materials affixed thereto, and wherein the second print element configured to image on the second side of the media during the second mode of operation for the printer while the first printer element is prevented from interface with the select portions of the first side of the media.

2. The printer of claim 1, wherein the first print element is further configured to prevent itself from interfacing with select portions of the first side of the media during the second mode of operation for the printer.

3. The printer of claim 1, wherein the first and second print elements are thermal print heads.

4. The printer of claim 1, wherein the first and second print elements are ink jet print heads.

5. The printer of claim 1, wherein physical dimensions of the first print element are narrower than that which is associated with the second print element, the physical dimensions prevent the first print element from contacting the select portions of the media having the adhesive material during the second mode of operation for the printer.

6. The printer of claim 1, wherein the first print element is configured to automatically relocate itself within the printer to avoid interfacing with the first side of the media during the second mode of operation for the printer.

7. The printer of claim 6, wherein first print element is configured to disable image capabilities associated with the first print element during the second mode of operation for the printer.

* * * * *